US011771970B2

(12) United States Patent
Parsons et al.

(10) Patent No.: US 11,771,970 B2
(45) **Date of Patent: *Oct. 3, 2023**

(54) GOLF EQUIPMENT COVERS AND METHODS TO MANUFACTURE GOLF EQUIPMENT COVERS

(71) Applicant: PARSONS XTREME GOLF, LLC, Scottsdale, AZ (US)

(72) Inventors: Robert R. Parsons, Scottsdale, AZ (US); Duane E. Pacha, Chandler, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 142 days.

This patent is subject to a terminal disclaimer.

(21) Appl. No.: 17/513,730

(22) Filed: Oct. 28, 2021

(65) Prior Publication Data

US 2022/0184477 A1 Jun. 16, 2022

Related U.S. Application Data

(63) Continuation of application No. 17/238,400, filed on Apr. 23, 2021, now Pat. No. 11,198,045.

(60) Provisional application No. 63/124,117, filed on Dec. 11, 2020.

(51) Int. Cl.

| | |
|---|---|
| ***A63B 57/00*** | (2015.01) |
| ***A63B 60/62*** | (2015.01) |
| *A63B 102/32* | (2015.01) |

(52) U.S. Cl.

CPC ..... *A63B 60/62* (2015.10); *A63B 2102/32* (2015.10); *A63B 2209/08* (2013.01); *A63B 2209/10* (2013.01); *A63B 2225/09* (2013.01)

(58) Field of Classification Search

CPC . A63B 60/62; A63B 2209/08; A63B 2225/09; A63B 2102/32; A63B 2209/10

See application file for complete search history.

(56) References Cited

U.S. PATENT DOCUMENTS

| | | | |
|---|---|---|---|
| 2,526,985 | A | 10/1950 | Whitehead |
| 3,023,795 | A | 3/1962 | Denkert |
| 3,548,908 | A | 12/1970 | Koetting |
| 3,821,976 | A | 7/1974 | Smith et al. |
| 3,861,434 | A | 1/1975 | Harding |

(Continued)

FOREIGN PATENT DOCUMENTS

| | | |
|---|---|---|
| KR | 20190000550 U | 3/2019 |

*Primary Examiner* — Raleigh W Chiu

(57) ABSTRACT

Examples of golf equipment covers and methods to manufacture golf equipment covers are generally described herein. In one example, a golf club head cover may include a body portion having an opening to receive a golf club head. The golf club head cover may include a magnetic portion that allows the golf club head cover to be magnetically attached to a metallic structure, such as a steel golf cart basket. The golf club head cover may include a magnet identifier located on or near the magnetic portion. The magnet identifier may notify an individual as to a location of the magnetic portion to aid the individual when the attaching the magnetic portion to the metallic structure. The golf club head cover may include a golf club head identifier that remains visible when the magnetic portion is magnetically attached to the metallic structure. Other examples may be described and claimed.

20 Claims, 6 Drawing Sheets

(56) References Cited

U.S. PATENT DOCUMENTS

| | | | | |
|---|---|---|---|---|
| 3,938,570 | A | 2/1976 | Stewart | |
| 3,965,955 | A | 6/1976 | Price | |
| 4,667,716 | A | 5/1987 | Solheim et al. | |
| 4,898,222 | A | 2/1990 | Gaffney | |
| 5,704,475 | A | 1/1998 | Jack | |
| 6,321,805 | B1 | 11/2001 | Suggs | |
| 7,458,405 | B1 | 12/2008 | Gaffney | |
| 7,686,049 | B2 | 3/2010 | Hwang | |
| 7,699,083 | B1 | 4/2010 | Kim | |
| D624,618 | S | 9/2010 | Gaffney | |
| D624,619 | S | 9/2010 | Gaffney | |
| D624,980 | S | 10/2010 | Gaffney | |
| 8,011,402 | B1 | 9/2011 | Gaffney | |
| D650,027 | S | 12/2011 | Gaffney | |
| D667,519 | S | 9/2012 | Gaffney | |
| 8,276,627 | B2 | 10/2012 | Gaffney | |
| D710,960 | S | 8/2014 | Gaffney | |
| 8,905,094 | B2 | 12/2014 | Gaffney | |
| 9,604,109 | B2 | 3/2017 | Gaffney | |
| 9,610,484 | B2 | 4/2017 | Gaffney | |
| 9,630,075 | B1 | 4/2017 | Wallace | |
| 9,675,858 | B1 | 6/2017 | Gaffney | |
| D796,607 | S | 9/2017 | Gaffney | |
| D820,930 | S | 6/2018 | Gaffney et al. | |
| 10,086,247 | B1 | 10/2018 | Gaffney | |
| D837,319 | S | 1/2019 | Gaffney et al. | |
| 10,369,443 | B2 | 8/2019 | Gaffney | |
| 10,537,776 | B2 | 1/2020 | Gaffney | |
| 11,198,045 | B1 * | 12/2021 | Parsons | A63B 60/62 |
| 2001/0035243 | A1 | 11/2001 | Choe | |
| 2003/0173009 | A1 | 9/2003 | Choe | |
| 2006/0054258 | A1 | 3/2006 | Lamparello et al. | |
| 2007/0015607 | A1 | 1/2007 | Hot | |
| 2007/0261976 | A1 | 11/2007 | Anderson | |
| 2009/0032154 | A1 | 2/2009 | Quartarone, III | |
| 2009/0188594 | A1 | 7/2009 | Cameron | |
| 2010/0051151 | A1 | 3/2010 | Chen | |
| 2011/0048596 | A1 | 3/2011 | Low et al. | |
| 2011/0265922 | A1 | 11/2011 | Gaffney | |
| 2012/0261043 | A1 | 10/2012 | Yanoff et al. | |
| 2013/0213538 | A1 | 8/2013 | Gaffney | |
| 2014/0202603 | A1 | 7/2014 | Huang | |
| 2017/0239539 | A1 | 8/2017 | Lee | |
| 2018/0330647 | A1 | 11/2018 | Sipek | |
| 2019/0060727 | A1 | 2/2019 | Goto et al. | |

* cited by examiner

GOLF EQUIPMENT COVERS AND METHODS TO MANUFACTURE GOLF EQUIPMENT COVERS

CROSS REFERENCE

This application is a continuation of U.S. patent application Ser. No. 17/238,400, filed on Apr. 23, 2021, which claims the benefit of U.S. Provisional Patent Application No. 63/124,117, filed on Dec. 11, 2020. The disclosures of the referenced applications are incorporated herein by reference.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment and, more particularly, to golf equipment covers and methods of manufacturing golf equipment covers.

BACKGROUND

Golf equipment covers may be manufactured using various materials and processes. Examples of golf equipment covers include covers designed to house golf club heads and alignment sticks.

Figure 1:
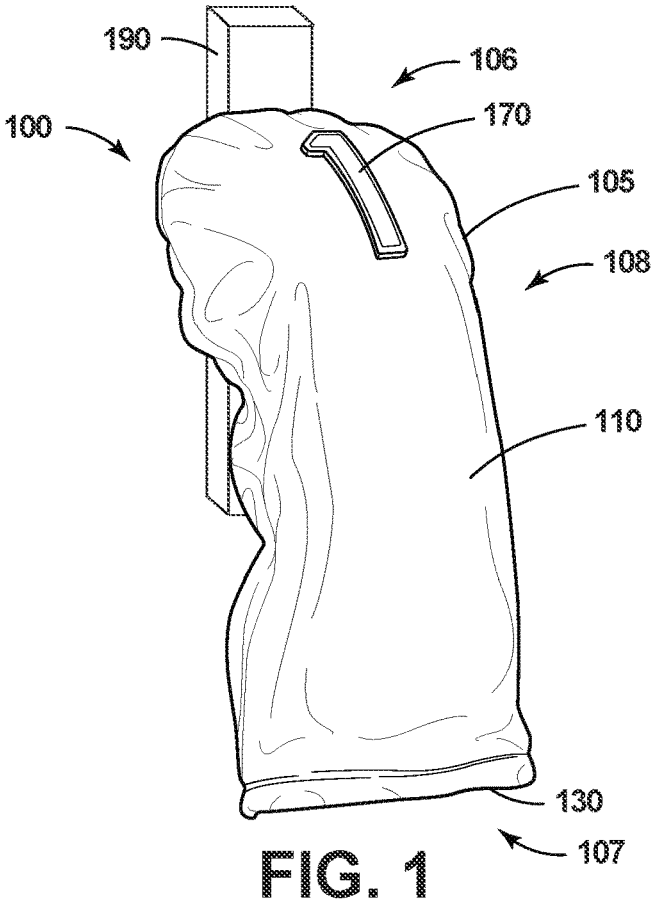
FIG. 1 depicts a front view of a golf club head cover according to an example of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of examples of the present disclosure.

DESCRIPTION

In general, golf equipment covers and methods to manufacture golf equipment covers are described herein. The apparatus, methods, and articles of manufacture described herein are not limited in this regard.

In the example of FIGS. 1-4, a golf club head cover 100 may include body portion 105. The body portion 105 may have a top portion 106, a bottom portion 107, a front portion 108, and a rear portion 109. The front portion 108 may include a golf club head identifier 170 that identifies a type of golf club head housed in the golf club head cover 100. The body portion 105 may have an outer shell portion 110. The body portion 105 may have an inner liner portion 120. The inner liner portion 120 may be coupled to an interior surface 111 of the outer shell portion 110. The outer shell portion 110 and the inner liner portion 120 may be coupled by, for example, a plurality of stitches. The inner liner portion 120 may define an opening 130 through which to receive a golf club head (not shown). The apparatus, methods, and articles of manufacture described herein are not limited in this regard.

The opening 130 may be located at the bottom portion 107 of the golf club head cover 100. The opening 130 may lead to an internal cavity 150 of the golf club head defined by the inner liner portion 120. The internal cavity 150 may be configured to house a golf club head. The opening 130 of the golf club head cover 100 or the opening of any of the golf club head covers described herein may include a fastening mechanism by which the opening may be closed or the size of the opening may be reduced to secure the golf club head in the internal cavity 150 and/or prevent the head cover 100 from being inadvertently removed from the golf club head. In one example, the fastening mechanism may be a hook and loop fastener. In another example, the fastening mechanism may include an elastic perimeter portion of the opening 130 that may prevent enlargement of the opening without sufficient force applied by an individual. In another example, the fastening mechanism may be a button or a snap at or proximate to the opening 130. In yet another example, the fastening mechanism may include a magnet closure (e.g., a magnet on one side of the opening and a metallic tab on an opposite side of the opening) located at or proximate to a perimeter portion of the opening 130. The apparatus, methods, and articles of manufacture described herein are not limited in this regard.

The outer shell portion 110 may be made from a resilient and/or relatively durable material such as, but not limited to, a polymer material (e.g., polyurethane (PU)), a suede material, a microfiber material, or a leather material. In one example, the outer shell portion 110 may be water resistant. In another example, the outer shell portion 110 may be waterproof. In yet another example, the outer shell portion 110 may protect the golf club head from ultraviolet radiation (e.g., prolonged exposure to sunlight). The apparatus, methods, and articles of manufacture described herein are not limited in this regard.

The inner liner portion 120 may be made from a soft natural or synthetic material such as, but not limited to, fleece, velour, microfiber, or sherpa. The inner liner portion 120 may protect a surface finish of a golf club head from being scratched or marred during transport. The apparatus, methods, and articles of manufacture described herein are not limited in this regard.

The golf club head cover 100 may include a magnetic portion 140. The magnetic portion 140 may allow an individual to adhere the golf club head cover 100 to a metallic structure 190 as a means to securely store the golf club head cover 100 during play. In one example, a metallic structure 190 may include any metallic portion of a golf cart (e.g., a steel basket or canopy support rail). In another example, a metallic structure 190 may include any portion of a golf club bag that may include a metallic structure. In yet another example, a metallic structure 190 may include any metallic object that may be near an individual during play. In this manner, the likelihood of the golf club head cover 100 being lost (e.g., falling out of the golf cart) or accidentally being left behind (e.g., at a tee box or on a fairway) during play may be lessened. The apparatus, methods, and articles of manufacture described herein are not limited in this regard.

Figure 2:
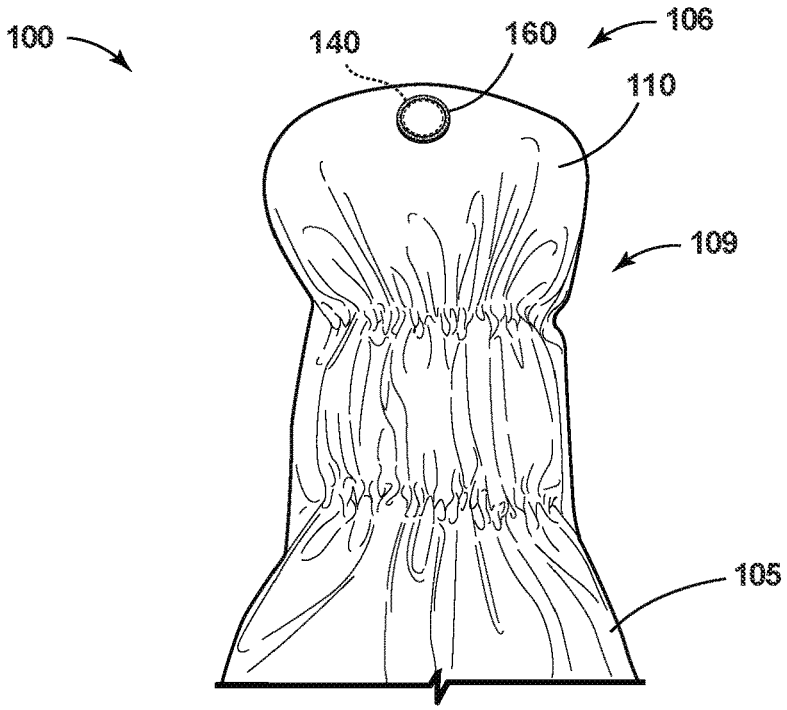
FIG. 2 depicts a rear view of the example golf club head cover of FIG. 1.
Figure 3:
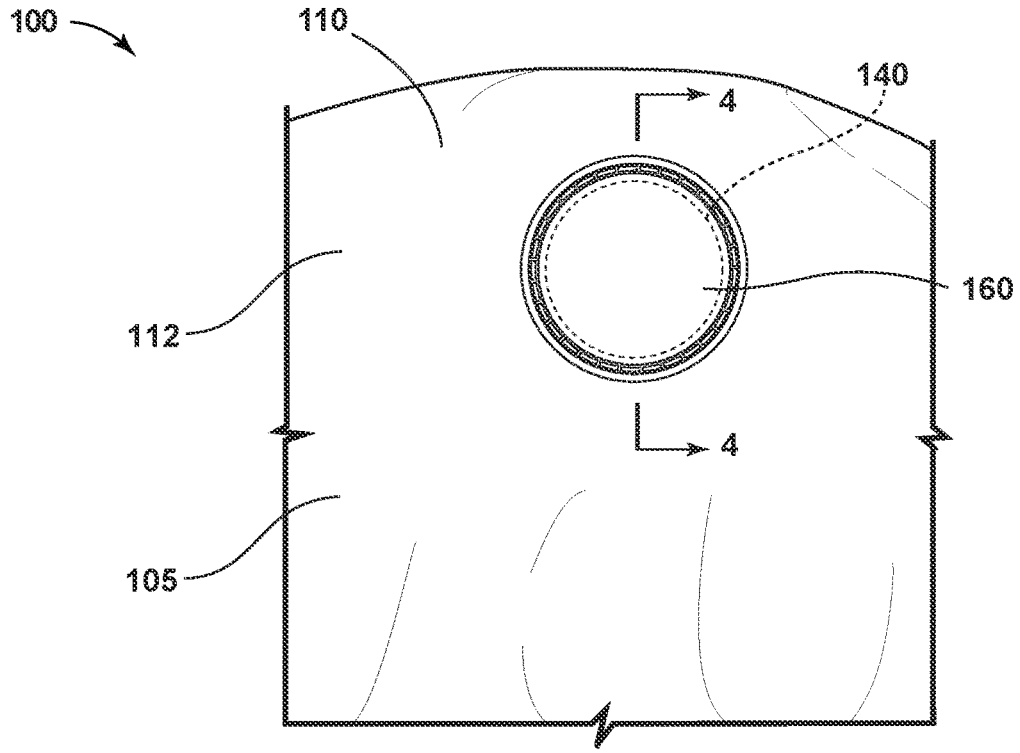
FIG. 3 depicts a partial rear view of the example golf club head cover of FIG. 1.

The magnetic portion 140 may include one or more magnet(s). The magnetic portion 140 may include one or more high-strength magnets (e.g., neodymium magnets). The magnetic portion 140 or the magnetic portion of any of the golf club head covers described herein may be any suitable shape, such as a disc, cylinder, block, ring, strip, or sheet. In one example, as shown in FIGS. 1-3, the magnetic portions 140 may be disc shaped. In another example, each magnetic portion 140 may include one or more magnetic strips. In another example, the magnetic portion 140 may include one magnetic strip that extends around all or portions of the top portion 106 of the golf club head cover 100. In yet another example, the magnetic portion 140 may include a plurality of spaced a part magnetic strips that may extend around all of portions of the top portion 106 of the golf club head cover 100. The apparatus, methods, and articles of manufacture described herein are not limited in this regard.

The magnetic portion 140 may be located at any position or one or more positions on the body portion 105. The magnetic portion 140 may span any continuous or discontinuous portion of the body portion 105 including, but not limited to, a longitudinal extent, a lateral extent, or a perimeter extent. A plurality of magnetic portions 140 may be located on the same, different or opposite sides of the body portion 105. In one example, a first magnetic portion 140 may be located on one side of the golf club head cover 100, and a second magnetic portion 140 may be located on an opposite side of the golf club head cover 100. The apparatus, methods, and articles of manufacture described herein are not limited in this regard.

In the example of FIGS. 1-4, the magnetic portion 140 may be concealed between the outer shell portion 110 and the inner liner portion 120. The magnetic portion 140 may be, for example, an N52 disc magnet concealed between the outer shell portion 110 and the inner liner portion 120. The magnetic portion 140 may be sewn in place or otherwise fastened to the body portion 105 to maintain the magnetic portion 140 in its location. The magnetic portion 140 may be centrally located at the top portion 106 and at the rear portion 109 of the body portion 105. Positioning the magnetic portion 140 at the top portion 106 and at the rear portion 109 may allow the golf club head cover 100 to hang in a way that allows the club head identifier 170 to be visible and right side up when the golf club head cover 100 is adhered to a chosen metallic structure 190, as shown in FIG. 1. Accordingly, with the magnetic portion 140 at the top portion 106 of the head cover 100, the opening 130 and any fastening mechanism for closing or reducing the size of the opening 130 as described herein may be at the bottom portion 107 or at a location on the head cover 100 opposite to the magnetic portion 140. This allows the individual to visually verify the golf club head cover 100 is the desired head cover before detaching the head cover from the metallic structure 190. This feature may be useful when the individual has multiple head covers adhered to the metallic structure 190 and needs to determine which of the head covers is the desired head cover. The golf club head cover 100 may include other magnetic portions at other locations on the golf club head cover 100. The apparatus, methods, and articles of manufacture described herein are not limited in this regard.

When an individual removes the golf club head cover 100 from a golf club, the individual may hold the golf club with one hand and remove the golf club head cover 100 with the other hand. Since the individual may only have one free hand to manage the golf club head cover 100, the individual may prefer to accomplish the task of adhering the golf club head cover 100 to the chosen metallic structure 190 with only one hand. Since the magnetic portion 140 is located at or near an external surface of the outer shell portion 110, the individual can easily adhere the golf club head cover 100 to a chosen metallic structure 190 without having to manually manipulate any aspect of the golf club head cover 100 to gain access to the magnetic portion 140. The apparatus, methods, and articles of manufacture described herein are not limited in this regard.

In the example of FIGS. 1-4, the magnetic portion 140 may be paired with a magnet identifier 160 visibly located on an exterior surface 112 of the outer shell portion 110. The magnet identifier 160 may be located proximate or generally coinciding with the location of the magnetic portion 140. In practice, the magnet identifier 160 may provide a visual indication to an individual as to a location of a nonvisible magnetic portion 140. Accordingly, the individual may simply orient the golf club head cover 100 to allow for the magnet identifier 160 to be placed against a chosen metallic structure 190, which may enable the golf club head cover 100 to be securely held in place due to magnetic attraction between the chosen metallic structure 190 and the magnetic portion 140 concealed within the golf club head cover 100. In addition to cushioning provided by the outer shell portion 110, the magnetic identifier 160 may provide cushioning between the magnetic portion 140 and the chosen metallic structure 190 and to protect a surface finish of the chosen metallic structure 190 from scratching or marring by the magnet portion. Cushioning provided by the magnet identifier 160 may serve to attenuate or dampen a sound associated with attaching the magnetic portion 140 to the chosen metallic structure 190 and to avoid producing a sound that may be distracting to golfers during play. The apparatus, methods, and articles of manufacture described herein are not limited in this regard.

The magnet identifier 160 may have a size that is smaller than, the same or about the same size as, or larger than the magnetic portion 140. The magnet identifier 160 may have the same shape as or a different shape than the magnetic portion 140. In one example, as shown in FIGS. 1-4, a disc shaped magnetic portion 140 may have a circular magnetic identifier 160. In another example, a strip shaped magnetic portion 140 may have a strip shaped magnetic identifier 160. In yet another example, a plurality of strip shaped magnetic portions 140 extending around the top portion 106 of the golf club head cover 100 may have a ring-shaped magnetic identifier 160 that correspondingly extends around the top portion 106 of the golf club head cover 100. The apparatus, methods, and articles of manufacture described herein are not limited in this regard.

The magnet identifier 160 may be a stitching, a sticker, a badge, a patch, an applique, or other identifying structure that may be an integral part of the golf club head cover 100 or provided as a separate component. In one example, the magnet identifier 160 may be made from a high friction material (e.g., rubber material) to provide slip resistance and wear resistance. The magnet identifier 160 may be permanently or semi-permanently coupled (e.g., sewn, painted, or glued) to the outer shell portion 110. The apparatus, methods, and articles of manufacture described herein are not limited in this regard.

Figure 5:
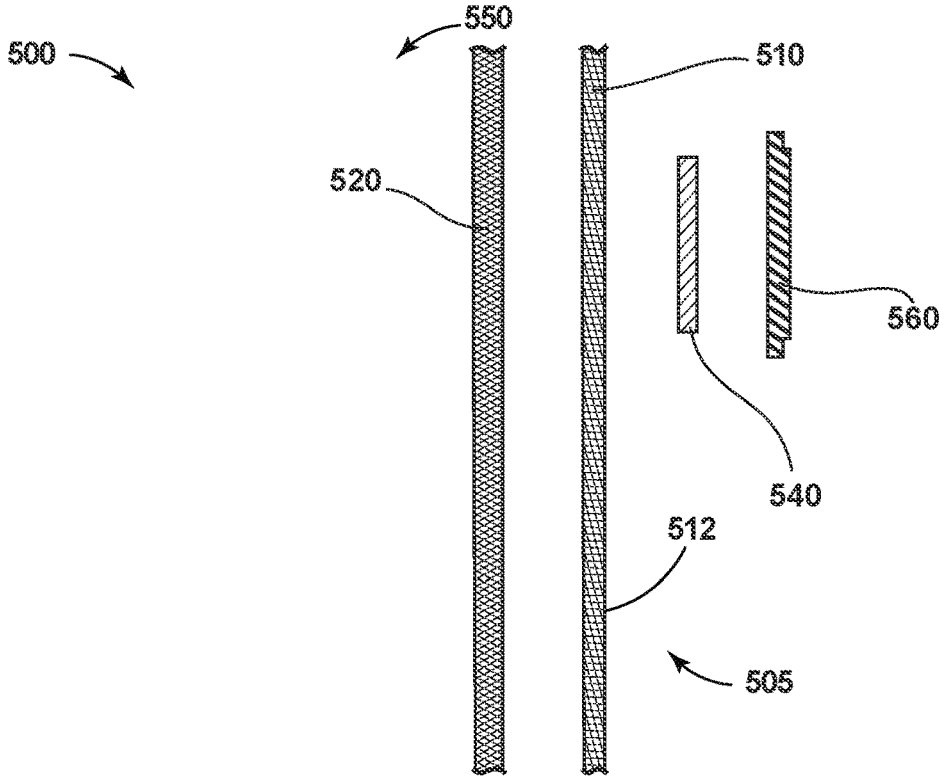
FIG. 5 depicts a partial cross-sectional exploded view of a golf club head cover according to an example of the apparatus, methods, and articles of manufacture described herein.

In the example of FIG. 5, a golf club head cover 500 may have a magnetic portion 540 located on an exterior surface 512 of an outer shell portion 510. The configuration of FIG. 5 may allow for retrofitting existing golf club head covers with the magnetic portion 540. The apparatus, methods, and articles of manufacture described herein are not limited in this regard.

In the example of FIG. 5, the inner liner portion 520 may be coupled to the outer shell portion 510 to form a body portion 505 similar to the body portion 105 of the golf club head cover 100 shown in FIG. 1. The body portion 505 may have a top portion, a bottom portion, a front portion, a rear portion, and an opening leading to an internal cavity 550 configured to receive a golf club head, similar to the golf club head cover 100 of FIG. 1. The apparatus, methods, and articles of manufacture described herein are not limited in this regard.

The magnetic portion 540 may allow the golf club head cover 500 to be attached to a chosen metallic structure, such as the metallic structure 190 as described herein with respect to the golf club head cover 100. In one example, the magnetic portion 540 may be adhered to an exterior surface 512 of the outer shell portion 510 by an adhesive. In another example, the magnetic portion 540 may include a material cover (e.g., fabric cover, not shown) that may be attached or sewn to the exterior surface 512 enclosing the magnetic portion therein. The magnetic portion 540 may be, for example, an N52 disc magnet. The apparatus, methods, and articles of manufacture described herein are not limited in this regard.

In the example of FIG. 5, the magnetic portion 540 may be paired with a magnet identifier 560 visibly located on the exterior surface 512 of the outer shell portion 510. The magnet identifier 560 may be located proximate or generally coinciding with the location of the magnetic portion 540. In practice, the magnet identifier 560 may provide a visual indication to an individual as to the location of the magnetic portion 540. Accordingly, the individual may simply orient the golf club head cover 500 to allow for the magnet identifier 560 to be placed against a chosen metallic structure, which may enable the golf club head cover 500 to be securely held in place due to magnetic attraction between the chosen metallic structure and the magnetic portion 540. The magnet identifier 560 may provide cushioning between the magnetic portion 540 and the chosen metallic structure and to protect a surface finish of the chosen metallic structure from scratching or marring by the magnetic portion. The magnet identifier 560 may provide cushioning between the magnetic portion 540 and the chosen metallic structure and to attenuate or dampen a sound produced when attaching the golf club head cover 500 to the chosen metallic structure. The apparatus, methods, and articles of manufacture described herein are not limited in this regard.

The magnet identifier 560 may be larger than the magnetic portion 540. The magnet identifier 560 may a badge, a patch, an applique, or other identifying structure that may be an integral part of the golf club head cover 500 or provided as a separate component. In one example, the magnet identifier 560 may be made from a high friction material (e.g., rubber) to provide slip resistance and wear resistance. The magnet identifier 560 may be permanently or semi-permanently coupled (e.g., sewn or glued) to the outer shell portion 510. In one example (not shown), the magnet identifier 560 may enclose the magnetic portion 540 and provide attachment of the magnetic portion 540 to the exterior surface 512. The apparatus, methods, and articles of manufacture described herein are not limited in this regard.

Figure 6:
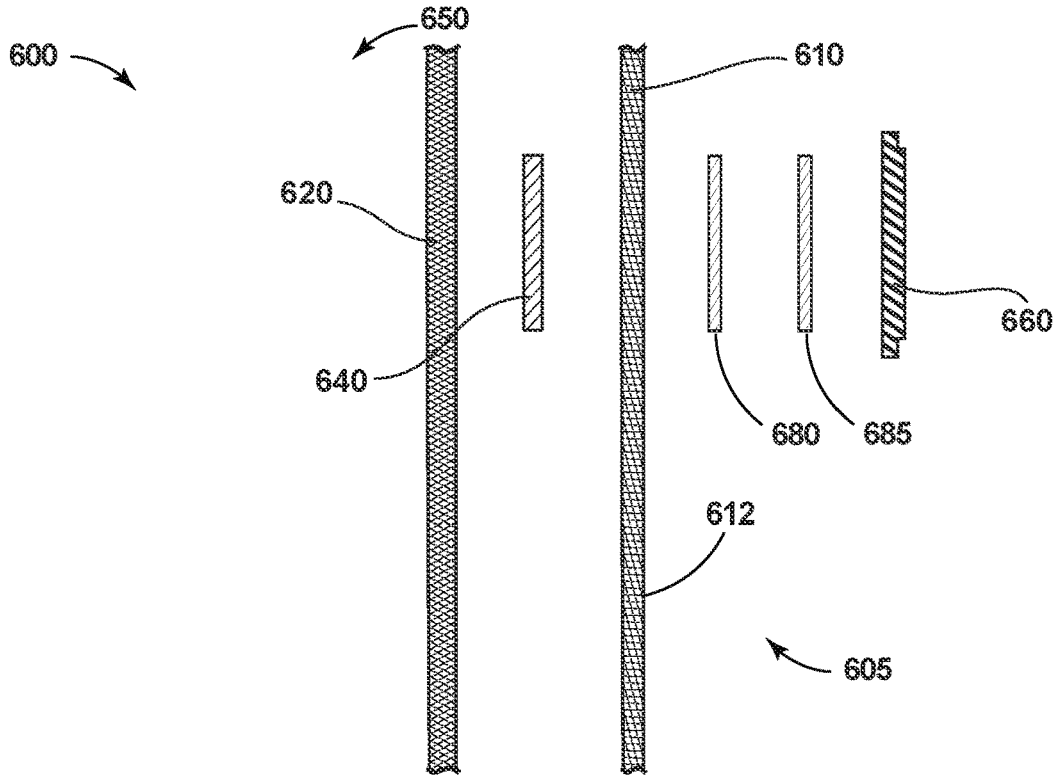
FIG. 6 depicts a partial cross-sectional exploded view of a golf club head cover according to an example of the apparatus, methods, and articles of manufacture described herein.

In the example of FIG. 6, a golf club head cover 600 may have an inner liner portion 620 and an outer shell portion 610. The inner liner portion 620 may be coupled to the outer shell portion 610 to form a body portion 605 similar to the body portion 105 of the golf club head cover 100 shown in FIG. 1. The body portion 605 may have a top portion, a bottom portion, a front portion, a rear portion, and an opening leading to an internal cavity 650 configured to receive a golf club head, similar to the golf club head cover 100 of FIG. 1. The apparatus, methods, and articles of manufacture described herein are not limited in this regard.

The golf club head cover 600 may have a magnetic portion 640 concealed between the inner liner portion 620 and the outer shell portion 610. The magnetic portion 640 may allow the golf club head cover 600 to be attached to a chosen metallic structure, such as the metallic structure 190 as described herein with respect to the golf club head cover 100. The magnetic portion 640 may be, for example, an N52 disc magnet. The apparatus, methods, and articles of manufacture described herein are not limited in this regard.

In the example of FIG. 6, the magnetic portion 640 may be paired with a magnet identifier 660 visibly located on an exterior surface 612 of the outer shell portion 610. The magnet identifier 660 may be located proximate or generally coinciding with the location of the magnetic portion 640. In practice, the magnet identifier 660 may provide a visual indication to an individual as to the location of the magnetic portion 640. Accordingly, the individual may simply orient the golf club head cover 600 to allow for the magnet identifier 660 to be placed against a chosen metallic structure, which may enable the golf club head cover 600 to be securely held in place due to magnetic attraction between the chosen metallic structure and the magnetic portion 640. The apparatus, methods, and articles of manufacture described herein are not limited in this regard.

The magnet identifier 660 may be removable from the golf club head cover 600. In one example, the magnet identifier 660 may be removably coupled to the outer shell portion 610 by a hook and loop fastener. A first portion of hook and loop material 680 may be coupled to an exterior surface 612 of the outer shell portion 610. A second portion of hook and loop material 685 may be coupled to the magnet identifier 660. In another example, the magnet identifier 660 may be removably coupled to the outer shell portion 610 by a snap. The magnet identifier 660 may be a removable ball marker. The removable ball marker may be suitable for marking a golf ball location on a putting green. The apparatus, methods, and articles of manufacture described herein are not limited in this regard.

Figure 7:
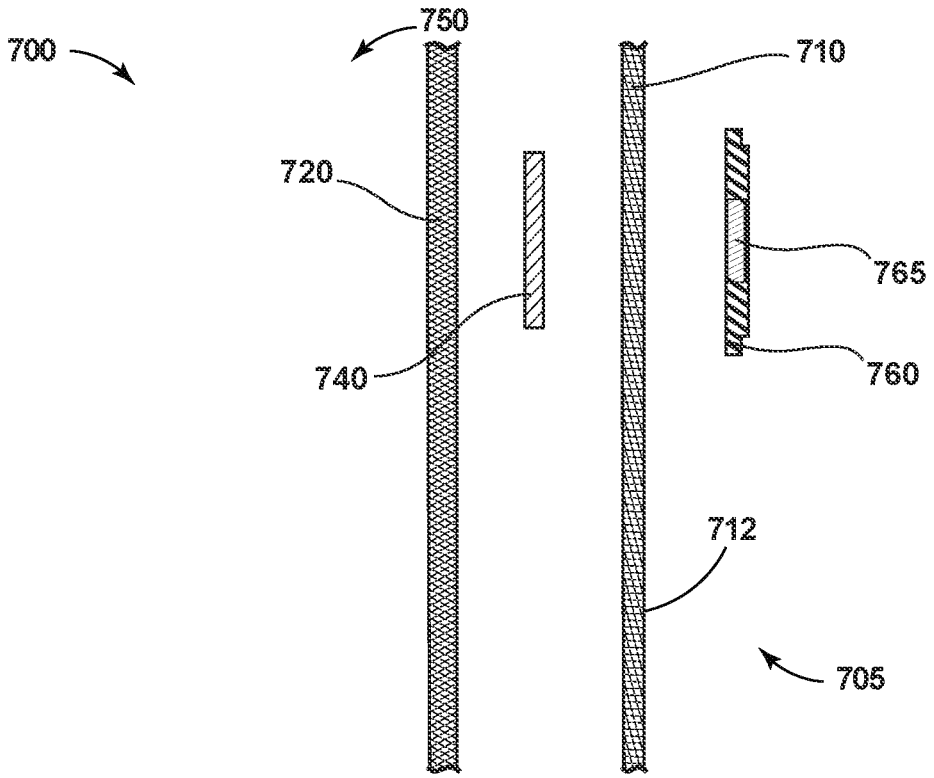
FIG. 7 depicts a partial cross-sectional exploded view of a golf club head cover according to an example of the apparatus, methods, and articles of manufacture described herein.

In the example of FIG. 7, a golf club head cover 700 may have an inner liner portion 720 and an outer shell portion 710. The inner liner portion 720 may be coupled to the outer shell portion 710 to form a body portion 705 similar to the body portion 105 of the golf club head cover 100 shown in FIG. 1. The body portion 705 may have a top portion, a bottom portion, a front portion, a rear portion, and an opening leading to an internal cavity 750 configured to receive a golf club head, similar to the golf club head cover 100 of FIG. 1. The apparatus, methods, and articles of manufacture described herein are not limited in this regard.

The golf club head cover 700 may have a magnetic portion 740 concealed between the inner liner portion 720 and the outer shell portion 710. The magnetic portion 740 may allow the golf club head cover 700 to be attached to a chosen metallic structure, such as the metallic structure 190 as described herein with respect to the golf club head cover 100. The magnetic portion 740 may be, for example, an N52 disc magnet. The apparatus, methods, and articles of manufacture described herein are not limited in this regard.

The magnet identifier 760 may be a removable magnet identifier. In one example, the magnet identifier 760 may be a removable ball marker. In another example, the magnet identifier 760 may be a poker style chip that serves as a removeable ball marker. The magnet identifier 760 may be removably coupled to an exterior surface 712 of the outer shell portion 710 by magnetic attraction. The magnet identifier 760 may include a ferrous portion 765 that is magnetically attracted to the magnetic portion 740. The ferrous portion 765 may be a steel portion. The ferrous portion 765 may be a steel insert. The magnet identifier 760 may be a polymer disk with a steel insert. In practice, an individual may remove the golf club head cover 700 from a designated golf club head, separate or pull apart the magnet identifier 760 from the magnetic portion 740 to enable the golf club head cover 700 to be adhered to a chosen metallic structure (e.g., a metallic structure of a golf cart or golf bag), employ the magnet identifier 760 as a ball marker during play, and recouple the magnet identifier 760 to the magnetic portion 740 after removing the golf club head cover 700 from the metallic structure. The apparatus, methods, and articles of manufacture described herein are not limited in this regard.

In the examples of FIGS. 1-4, the golf club head cover 100 may include a magnetic portion 140 with a magnet identifier 160 on one side of the head cover 100 and a club head identifier 170 on an opposite or different side of the head cover 100. In another example, the golf club head cover 100 or any of the golf club head covers described herein may include another magnetic portion 140 on the same side as the club head identifier 170 such that the club head identifier 170 may function similar to a magnetic portion 140. In other words, the golf club head cover 100 may include two magnetic portions 140 on opposing or different sides of the head cover 100, with the location of one magnetic portion 140 being visually indicated by the magnet identifier 160, and the location of the other magnetic portion 140 being visually indicated by the club head identifier 170. Accordingly, an individual may secure the golf club head cover 100 to a chosen metallic structure 190 either by the side of the golf club head cover 100 that includes the magnet identifier 160, or by the side of the head cover 100 that includes the club head identifier 170. In yet another example, the golf club head cover 100 or any of the golf club head covers described herein may include a first magnetic portion 140 on one side of the head cover 100 that may be visually indicated by a first magnet identifier 160 and a second magnetic portion 140 on an opposite or different side of the head cover 100 that may be visually indicated by a second magnet identifier 160. The golf club head cover 100 of this example may include one or more club head identifiers 170 that may be located on a portion of the head cover 100 that may be different from the locations of the first and second magnetic portion and yet be clearly visible to an individual when using the head cover 100. In yet another example, the golf club head cover 100 or any of the golf club head covers described herein may include a first magnetic portion 140 on one side of the head cover 100 and a second magnetic portion 140 on an opposite or different side of the head cover 100. The first magnetic portion 140 may be visually indicated with a first club head identifier 170 instead of a magnet identifier 160 as described herein. The second magnetic portion 140 may also be visually indicated with a second club head identifier 170 instead of a magnet identifier 160. In other words, in this example, the head cover 100 may include two magnetic portions 140 on opposite or different sides of the head cover 100 which are visually indicated by two corresponding club head identifiers 170. Accordingly, in any of the examples described herein, a head cover may include any number of magnetic portions that may be visually indicated with magnet identifiers 160 and/or club head identifiers 170. In other words, any club head identifier 170 may function as a magnet identifier 160 and constructed from such materials as described herein with respect to a magnet identifier 160. Although the above examples are described with respect to the head cover 100 of FIGS. 1-4, the configurations of the magnetic portions, magnet identifiers, and/or club head identifiers are equally applicable to the head covers of FIGS. 5-11 as described herein. The apparatus, methods, and articles of manufacture described herein are not limited in this regard.

Figure 8:
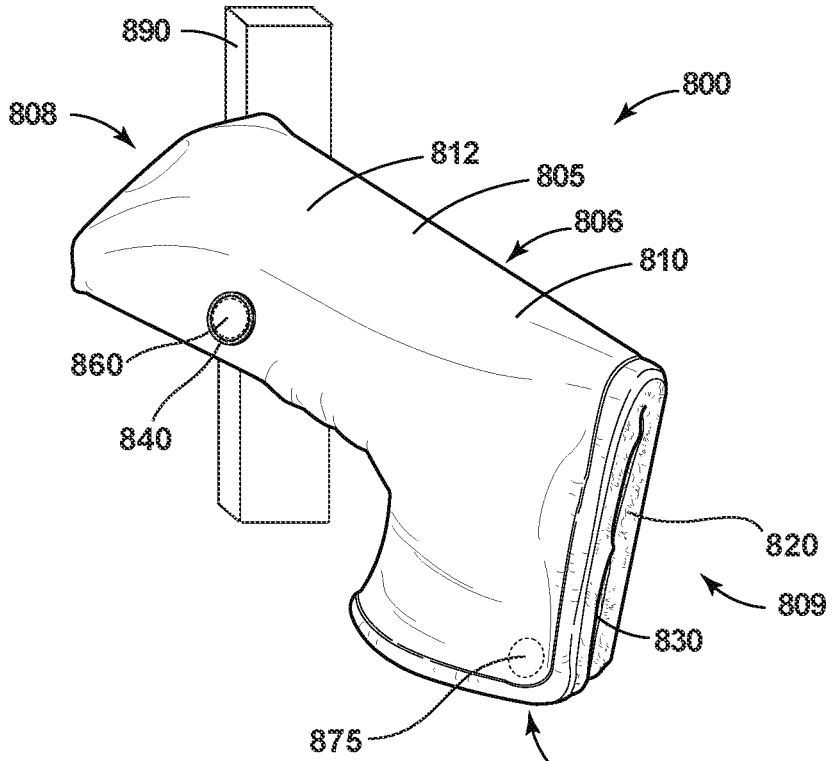
FIG. 8 depicts a side perspective view of a golf club head cover according to an example of the apparatus, methods, and articles of manufacture described herein.
Figure 9:
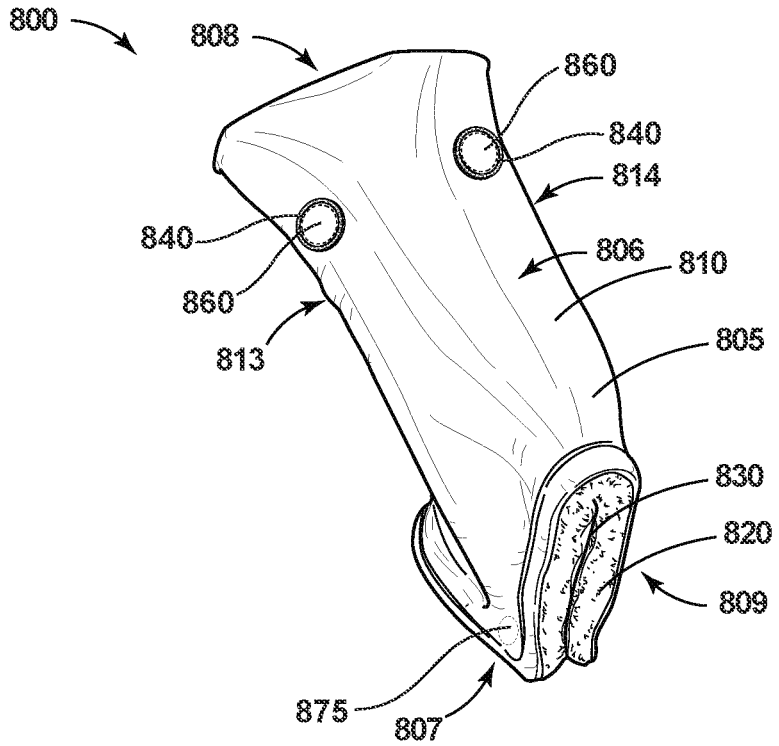
FIG. 9 depicts a top perspective view of the example golf club head cover of FIG. 8.

In the example of FIGS. 8 and 9, a golf club head cover 800 may include body portion 805. The body portion 805 may have a top portion 806, a bottom portion 807, a front portion 808, and a rear portion 809. The front portion 808 may include a golf club head identifier (not shown) that identifies a type of golf club head housed in the golf club head cover 800. The body portion 805 may have an outer shell portion 810. The body portion 805 may have an inner liner portion 820. The inner liner portion 820 may be coupled to an interior surface of the outer shell portion 810. The outer shell portion 810 and the inner liner portion 820 may be coupled by, for example, a plurality of stitches. The inner liner portion 820 may define an opening 830 through which to receive a golf club head (not shown). The apparatus, methods, and articles of manufacture described herein are not limited in this regard.

The opening 830 may be located at the bottom portion 807 of the golf club head cover 800. The opening 830 may extend from the bottom portion 807 to the rear portion 809. The opening 830 may lead to an internal cavity of the golf club head cover 800 defined by the inner liner portion 820. The internal cavity may be configured to house a golf club head, such as a putter (not shown). The opening 830 may include a fastening mechanism by which the opening 830 may be closed or the size of the opening 830 may be reduced to secure the golf club head in the internal cavity and/or prevent the golf club head cover 800 from being inadvertently removed from the golf club head. In one example, as shown in FIG. 8, the fastening mechanism may include a magnet closure 875 (e.g., a magnet on one side of the opening and a metallic tab on an opposite side of the opening) located at or proximate to a perimeter portion of the opening 830. In another example, the fastening mechanism may be a hook and loop fastener, a snap, a button, or a zipper. The apparatus, methods, and articles of manufacture described herein are not limited in this regard.

The outer shell portion 810 may be made from a resilient and/or relatively durable material such as, but not limited to, a polymer material (e.g., polyurethane (PU)), a suede material, a microfiber material, or a leather material. In one example, the outer shell portion 810 may be water resistant. In another example, the outer shell portion 810 may be waterproof. In yet another example, the outer shell portion 810 may protect the golf club head from ultraviolet radiation (e.g., prolonged exposure to sunlight). The apparatus, methods, and articles of manufacture described herein are not limited in this regard.

The inner liner portion 820 may be made from a soft natural or synthetic material such as, but not limited to, fleece, velour, microfiber, or sherpa. The inner liner portion 820 may protect a surface finish of a golf club head from being scratched or marred during transport. The apparatus, methods, and articles of manufacture described herein are not limited in this regard.

The golf club head cover 800 may include one or more magnetic portions 840. Each magnetic portion 840 may allow an individual to adhere the golf club head cover 800 to a metallic structure 890 as a means to securely store the golf club head cover 800 during play. In one example, a metallic structure 890 may include any metallic portion of a golf cart (e.g., a steel basket or canopy support rail). In another example, a metallic structure 890 may include any portion of a golf club bag that may include a metallic structure. In yet another example, a metallic structure 890 may include any metallic object that may be near an individual during play. In this manner, the likelihood of the golf club head cover 800 being lost (e.g., falling out of the golf cart) or accidentally being left behind (e.g., at a tee box or on a fairway) during play may be lessened. The apparatus, methods, and articles of manufacture described herein are not limited in this regard.

Each magnetic portion 840 may include one or more magnet(s). Each magnetic portion 840 may include one or more high-strength magnets (e.g., neodymium magnets). Each magnetic portion 840 may be any suitable shape, such as a disc, cylinder, block, ring, strip, or sheet. In one example, as shown in FIGS. 8 and 9, the magnetic portions 840 may be disc shaped. In another example, each magnetic portion 840 may include one or more magnetic strips. In another example, the magnetic portion 840 may include one magnetic strip that extends around all or portions of the top portion 806 of the golf club head cover 800. In yet another example, the magnetic portion 840 may include a plurality of spaced a part magnetic strips that may extend around all of portions of the top portion 806 of the golf club head cover 800. The apparatus, methods, and articles of manufacture described herein are not limited in this regard.

Each magnetic portion 840 may be located at any position or one or more positions on the body portion 805. Each magnetic portion 840 may span any continuous or discontinuous portion of the body portion 805 including, but not limited to, a longitudinal extent, a lateral extent, or a perimeter extent. A plurality of magnetic portions 840 may be located on the same, different or opposite sides of the body portion 805. In one example, as shown in FIG. 9, a first magnetic portion 840 may be located on a left side portion 813 (i.e., the left side portion as viewed in FIG. 9) of the golf club head cover 800, and a second magnetic portion 840 may be located on the opposite side or a right side portion 814 (i.e., the right side portion as viewed in FIG. 9) of the golf club head cover 800. In another example, the magnetic portion 840 may be located at or proximate to the front portion 808. In yet another example, the front portion 808, the left side portion 813, the right side portion 814, and/or any location therebetween and/or on the top portion 806 may include a single magnetic portion or a plurality of magnetic portions 840. The apparatus, methods, and articles of manufacture described herein are not limited in this regard.

Figure 4:
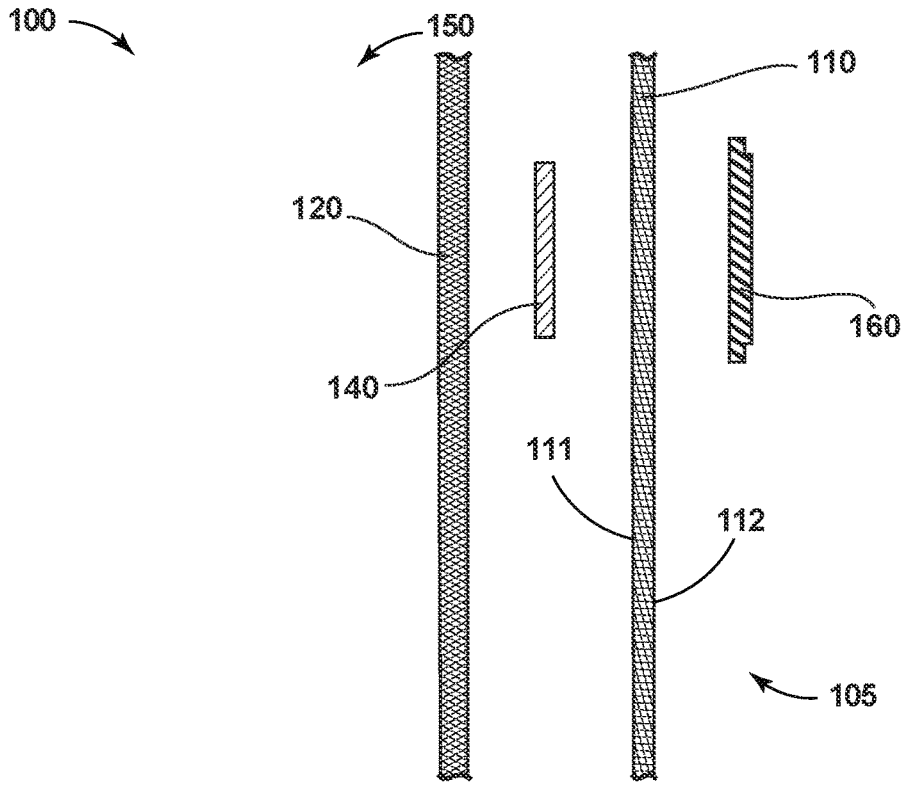
FIG. 4 depicts a partial cross-sectional exploded view of the example golf club head cover of FIG. 1 taken along Section 4-4.

In one example, each magnetic portion 840 may be concealed between the outer shell portion 810 and the inner liner portion 820, similar to the configurations shown in FIG. 4, 6, or 7. Each magnetic portion 840 may be, for example, an N52 disc magnet concealed between the outer shell portion 810 and the inner liner portion 820. Each magnetic portion 840 may be sewn in place or otherwise fastened to the body portion 805 to maintain the magnetic portion 840 in its location. In another example, each magnetic portion 840 may be attached to the exterior surface 812 of the outer shell portion 810, similar to the configuration shown in FIG. 5. The apparatus, methods, and articles of manufacture described herein are not limited in this regard.

When an individual removes the golf club head cover 800 from a golf club, the individual may hold the golf club with one hand and remove the golf club head cover 800 with the other hand. Since the individual may only have one free hand to manage the golf club head cover 800, the individual may prefer to accomplish the task of adhering the golf club head cover 800 to the chosen metallic structure 890 with only one hand. Since the magnetic portions 840 are located at or near an external surface of the outer shell portion 810, the individual can easily adhere the golf club head cover 800 to a chosen metallic structure 890 without having to manually manipulate any aspect of the golf club head cover 800 to gain access to the magnetic portion 840. The apparatus, methods, and articles of manufacture described herein are not limited in this regard.

In the example of FIGS. 8 and 9, each magnetic portion 840 may be paired with a magnet identifier 860 visibly located on an exterior surface 812 of the outer shell portion 810. Each magnet identifier 860 may be located proximate or generally coinciding with a location of a magnetic portion 840. In practice, each magnet identifier 860 may provide a visual indication to an individual as to a location of a nonvisible magnetic portion 840. Accordingly, the individual may simply orient the golf club head cover 800 to allow for the magnet identifier 860 to be placed against a chosen metallic structure 890, which may enable the golf club head cover 800 to be securely held in place due to magnetic attraction between the chosen metallic structure and the magnetic portion 840 concealed within the golf club head cover 800. The magnet identifier 860 may provide cushioning, in addition to cushioning provided by the outer shell portion 810, between the magnetic portion 840 and the chosen metallic structure 890 and to protect a surface finish of the chosen metallic structure 890 from scratching or marring by the magnet portion 840. Cushioning provided by the magnet identifier 860 may serve to attenuate or dampen a sound associated with attaching the magnetic portion 840 to the chosen metallic structure 890 and to avoid producing a sound that may be distracting to golfers during play. The apparatus, methods, and articles of manufacture described herein are not limited in this regard.

The magnet identifier 860 may have a size that is smaller than, the same or about the same size as, or larger than the magnetic portion 840. The magnet identifier 860 may have the same shape as or a different shape than the magnetic portion 840. In one example, as shown in FIGS. 8 and 9, a disc shaped magnetic portion 840 may have a circular magnetic identifier 860. In another example, a strip shaped magnetic portion 840 may have a strip shaped magnetic identifier 860. In yet another example, a plurality of strip shaped magnetic portions 840 extending around the top portion 806 of the golf club head cover 800 may have a ring-shaped magnetic identifier 860 that correspondingly extends around the top portion 806 of the golf club head cover 800. The apparatus, methods, and articles of manufacture described herein are not limited in this regard.

The magnet identifier 860 may be a stitching, a sticker, a badge, a patch, an applique, or other identifying structure that may be an integral part of the golf club head cover 800 or provided as a separate component. In one example, the magnet identifier 860 may be made from a high friction material (e.g., rubber material) to provide slip resistance and wear resistance. The magnet identifier 860 may be permanently or semi-permanently coupled (e.g. sewn, painted, or glued) to the outer shell portion 810. The apparatus, methods, and articles of manufacture described herein are not limited in this regard.

Figure 10:
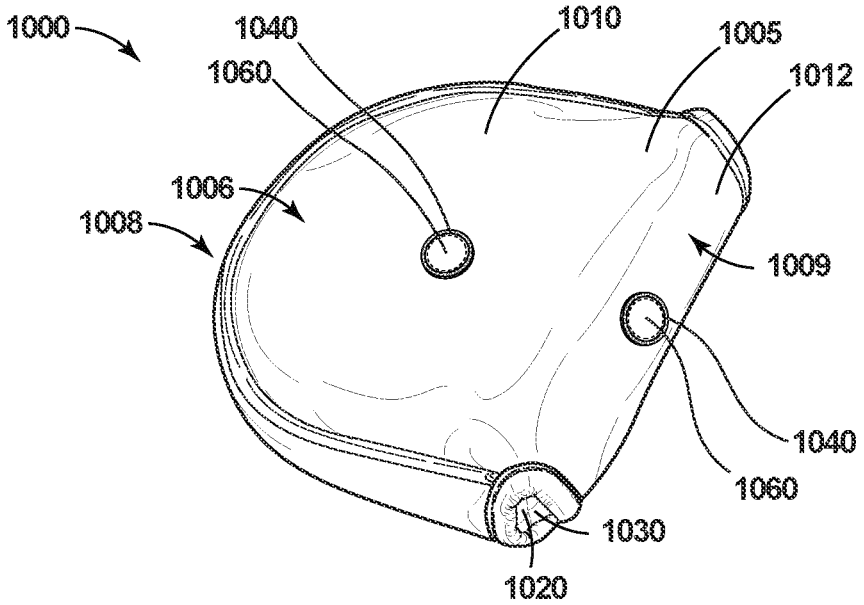
FIG. 10 depicts a top perspective view of a golf club head cover according to an example of the apparatus, methods, and articles of manufacture described herein.
Figure 11:
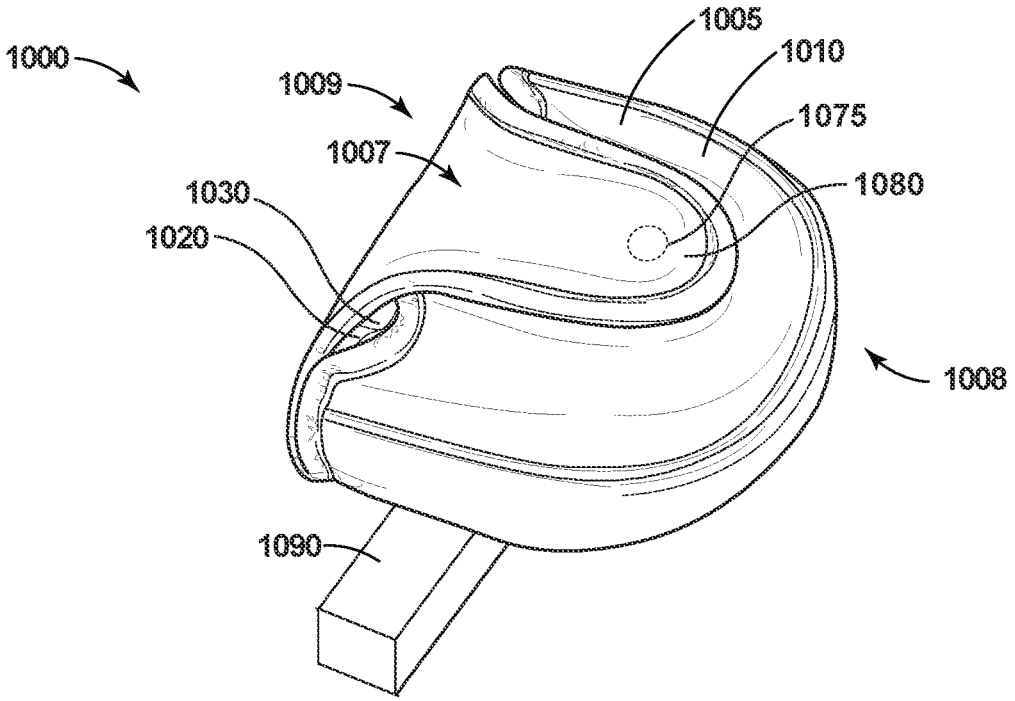
FIG. 11 depicts a bottom perspective view of the example golf club head cover of FIG. 10.

In the example of FIGS. 10 and 11, a golf club head cover 1000 may include body portion 1005. The body portion 1005 may have a top portion 1006, a bottom portion 1007, a front portion 1008, and a rear portion 1009. The front portion 1008 may include a golf club head identifier (not shown) that identifies a type of golf club head housed in the golf club head cover 1000. The body portion 1005 may have an outer shell portion 1010. The body portion 1005 may have an inner liner portion 1020. The inner liner portion 1020 may be coupled to an interior surface of the outer shell portion 1010. The outer shell portion 1010 and the inner liner portion 1020 may be coupled by, for example, a plurality of stitches. The inner liner portion 1020 may define an opening 1030 through which to receive a golf club head (not shown). The apparatus, methods, and articles of manufacture described herein are not limited in this regard.

The opening 1030 may be located at the rear portion 1009 of the golf club head cover 1000. The opening 1030 may lead to an internal cavity of the golf club head cover 1000 defined by the inner liner portion 1020. The internal cavity may be configured to house a golf club head, such as a putter (not shown). The opening 1030 may include a fastening mechanism by which the opening may be closed or the size of the opening may be reduced to secure the golf club head in the internal cavity and/or prevent the head cover 1000 from being inadvertently removed from the golf club head. The fastening mechanism may include a magnet closure 1075 located within a closure flap 1080 of the golf club head cover. When in an open position, the closure flap 1080 may provide access to the opening 1030 and allow a golf club head to be inserted into or removed from the internal cavity. When in a closed position, the closure flap 1080 may cover the opening 1030 and fasten to the outer shell portion via the magnet closure 1075. The apparatus, methods, and articles of manufacture described herein are not limited in this regard.

The outer shell portion 1010 may be made from a resilient and/or relatively durable material such as, but not limited to, a polymer material (e.g., polyurethane (PU)), a suede material, a microfiber material, or a leather material. In one example, the outer shell portion 810 may be water resistant. In another example, the outer shell portion 1010 may be waterproof. In yet another example, the outer shell portion 1010 may protect the golf club head from ultraviolet radiation (e.g., prolonged exposure to sunlight). The apparatus, methods, and articles of manufacture described herein are not limited in this regard.

The inner liner portion 1020 may be made from a soft natural or synthetic material such as, but not limited to, fleece, velour, microfiber, or sherpa. The inner liner portion 1020 may protect a surface finish of a golf club head from being scratched or marred during transport. The apparatus, methods, and articles of manufacture described herein are not limited in this regard.

The golf club head cover 1000 may include one or more magnetic portions 1040. Each magnetic portion 1040 may allow an individual to adhere the golf club head cover 1000 to a metallic structure 1090 as a means to securely store the golf club head cover 1000 during play. In one example, a metallic structure 1090 may include any metallic portion of a golf cart (e.g., a steel basket or canopy support rail). In another example, a metallic structure 1090 may include any portion of a golf club bag that may include a metallic structure. In yet another example, a metallic structure 1090 may include any metallic object that may be near an individual during play. In this manner, the likelihood of the golf club head cover 1000 being lost (e.g., falling out of the golf cart) or accidentally being left behind (e.g., at a tee box or on a fairway) during play may be lessened. The apparatus, methods, and articles of manufacture described herein are not limited in this regard.

Each magnetic portion 1040 may include one or more magnet(s). Each magnetic portion 1040 may include one or more high-strength magnets (e.g., neodymium magnets). Each magnetic portion 1040 can be any suitable shape, such as a disc, cylinder, block, ring, strip, or sheet. Each magnetic portion 1040 may be located at any position on the body portion 1005. Each magnetic portion 1040 may span any continuous or discontinuous portion of the body portion 1005 including, but not limited to, a longitudinal extent, a lateral extent, or a perimeter extent. The apparatus, methods, and articles of manufacture described herein are not limited in this regard.

In one example, each magnetic portion 1040 may be concealed between the outer shell portion 1010 and the inner liner portion 1020, similar to the configurations shown in FIG. 4, 6, or 7. Each magnetic portion 1040 may be, for example, an N52 disc magnet concealed between the outer shell portion 1010 and the inner liner portion 1020. Each magnetic portion 1040 may be sewn in place or otherwise fastened to the body portion 1005 to maintain the magnetic portion 1040 in its location. In another example, each magnetic portion 1040 may be attached to the exterior surface 1012 of the outer shell portion 1010, similar to the configuration shown in FIG. 5. The apparatus, methods, and articles of manufacture described herein are not limited in this regard.

A first magnetic portion 1040 may be located on a top portion 1006 of the golf club head cover. A second magnetic portion 1040 may be located on the rear portion 1009 of the golf club head cover. The apparatus, methods, and articles of manufacture described herein are not limited in this regard.

When an individual removes the golf club head cover 1000 from a golf club, the individual may hold the golf club with one hand and remove the golf club head cover 1000 with the other hand. Since the individual may only have one free hand to manage the golf club head cover 1000, the individual may prefer to accomplish the task of adhering the golf club head cover 1000 to the chosen metallic structure 1090 with only one hand. Since the magnetic portions 1040 are located at or near an external surface of the outer shell portion 1010, the individual can easily adhere the golf club head cover 1000 to a chosen metallic structure 1090 without having to manually manipulate any aspect of the golf club head cover 1000 to gain access to either magnetic portion 1040. The apparatus, methods, and articles of manufacture described herein are not limited in this regard.

In the example of FIGS. 10 and 11, each magnetic portion 1040 may be paired with a magnet identifier 1060 visibly located on an exterior surface 1012 of the outer shell portion 1010. Each magnet identifier 1060 may be located proximate or generally coinciding with a location of a magnetic portion 1040. In practice, each magnet identifier 1060 may provide a visual indication to an individual as to a location of a nonvisible magnetic portion 1040. Accordingly, the individual may simply orient the golf club head cover 1000 to allow for the magnet identifier 1060 to be placed against a chosen metallic structure 1090, which may enable the golf club head cover 1000 to be securely held in place due to magnetic attraction between the chosen metallic structure and the magnetic portion 1040 concealed within the golf club head cover 1000. The magnet identifier 1060 may provide cushioning, in addition to cushioning provided by the outer shell portion 1010, between the magnetic portion 1040 and the chosen metallic structure 1090 and to protect a surface finish of the chosen metallic structure 1090 from scratching or marring by the magnet portion. Cushioning provided by the magnet identifier 1060 may serve to attenuate or dampen a sound associated with attaching the magnetic portion 1040 to the chosen metallic structure 890 and to avoid producing a sound that may be distracting to golfers during play. The apparatus, methods, and articles of manufacture described herein are not limited in this regard.

The magnet identifier 1060 may have a size that is smaller than, the same or about the same size as, or larger than the magnetic portion 1040. The magnet identifier 1060 may be a stitching, a sticker, a badge, a patch, an applique, or other identifying structure that may be an integral part of the golf club head cover 1000 or provided as a separate component. In one example, the magnet identifier 1060 may be made from a high friction material (e.g., rubber material) to provide slip resistance and wear resistance. The magnet identifier 1060 may be permanently or semi-permanently coupled (e.g. sewn, painted, or glued) to the outer shell portion 1010. The apparatus, methods, and articles of manufacture described herein are not limited in this regard.

While the above examples may describe and depict a magnetic identifier or a magnetic portion located on an opposite side or a different side of a club head identifier of a golf club head cover, the apparatus, methods, and articles of manufacture described herein may include a magnetic identifier or a magnetic portion located on the same side of a club head identifier. Further, the magnetic portion may be a portion of or embedded in the club head identifier. Although the above examples may describe and depict a single magnetic portion, the apparatus, methods, and articles of manufacture described herein may be include two or more magnetic portions. While the above examples may describe and depict a golf club head cover having a magnetic identifier or a magnetic portion located on a rear portion, the apparatus, methods, and articles of manufacture described herein may include a magnetic identifier or a magnetic portion located on a front portion or a side portion of a golf club head cover.

As described herein, a magnet identifier may have the same shape as or a different shape than a magnetic portion. For example, as described herein a disc shaped magnetic portion may have a circular magnetic identifier, and a strip shaped magnetic portion may have a strip shaped magnetic identifier. In yet another example, the magnetic identifier may include alphanumeric characters and/or a log associated with a certain brand of products such as golf clubs. Accordingly, a magnetic identifier may serve multiple functions including identifying a location of a magnetic portion, providing an enhanced frictional surface for adhering a golf club head cover to a metallic structure, providing cushioning and noise dampening when the magnetic portion adheres to a metallic structure, and/or displaying a logo or a brand name of an entity associated with the golf club head cover or golf equipment. The apparatus, methods, and articles of manufacture described herein are not limited in this regard.

With respect to any of the examples provided herein, the magnet identifier may be visually represented as an icon, a logo, a symbol, include alphanumeric characters, or other visual art that is discernable from other features that may be present on the golf club head cover. The magnet identifier may be visually differentiated from the rest of the golf club head cover by way of color, texture, pattern, etc. The apparatus, methods, and articles of manufacture described herein are not limited in this regard.

While each of the above examples may describe and depict certain features and configurations of one or more parts of a golf club head cover, such features and configurations of the one or more parts of one golf club head cover are applicable to any of the other golf club head covers described and depicted herein. For example, the golf club head cover 100 may include magnetic portions one opposite sides of the golf club head cover 100 as described and depicted for to the golf club head cover 800. The apparatus, methods, and articles of manufacture described herein are not limited in this regard.

In contrast to a magnetic fastener for closing an opening to secure a golf club head in a golf club head cover, a magnetic portion as described and depicted in the above examples (e.g., one as 140 in FIG. 1, 640 in FIG. 6, 840 in FIG. 8, and 1040 in FIG. 10) may be located away from the opening at various locations or positions of the golf club head cover. Without being used to close the opening of the golf club head cover, the magnetic portion may be used to adhere to a metallic structure (e.g., a steel basket or a canopy support rail of a golf cart) to reduce the probability of the golf club head cover from being lost or left behind. Although the above examples may describe and depict a magnetic portion located at a particular location or position of a golf club head cover to adhere the golf club head cover to a metallic structure, the apparatus, methods, and articles of manufacture described herein may include one or more magnetic portions located at, for example, a top portion, a bottom portion, a rear portion, a toe portion, a heel portion, a left side portion, a right side portion, a front portion, a back portion, a central portion, a middle portion, or any other portions of a golf club head cover or any combination thereof). While the golf club head covers are generally shown as driver or wood type golf club head covers or putter golf club head covers, any of the golf club head covers shown may be configured to house any type of golf club heads including an iron type golf club head, or a wedge type golf club head. It will be appreciated that the present disclosure may similarly apply to alignment stick covers. The apparatus, methods, and articles of manufacture described herein are not limited in this regard.

The terms "and" and "or" may have both conjunctive and disjunctive meanings. The terms "a" and "an" are defined as one or more unless this disclosure indicates otherwise. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R & A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head cover comprising:

a body portion having a top portion, a bottom portion, a front portion, a rear portion opposite the front portion, and an opening located in the bottom portion and leading to an internal cavity configured to receive a golf club head;

a magnetic portion concealed within the rear portion and configured to magnetically attach the golf club head cover to a metallic structure;

a magnet identifier located on an exterior surface of the rear portion and configured to identify a location of the magnetic portion; and a golf club head identifier located on an exterior surface of the front portion, the golf club head identifier located between a top edge and a bottom edge of the front portion and configured to identify a type of golf club head that the internal cavity is configured to receive, wherein when the magnetic portion is magnetically attached to a metallic structure, the golf club head identifier is visible and the magnet identifier is in contact with the metallic structure and located between the metallic structure and the magnetic portion.

2. A golf club head cover as defined in claim 1, wherein the magnet identifier is permanently attached to the exterior surface of the rear portion.

3. A golf club head cover as defined in claim 1, wherein the magnet identifier is removably attached to the exterior surface of the rear portion.

4. A golf club head cover as defined in claim 1, wherein when the magnetic portion is magnetically attached to a metallic structure, the magnet identifier provides physical separation between the magnetic portion and the metallic structure.

5. A golf club head cover as defined in claim 1, wherein the magnet identifier is a removable ball marker.

6. A golf club head cover as defined in claim 1, wherein the magnet identifier is a removable ball marker comprising a ferrous material that is magnetically attracted to the magnetic portion.

7. A golf club head cover as defined in claim 1, further comprising an inner liner portion coupled to an interior surface of an outer shell portion, wherein the magnetic portion is concealed between the inner liner portion and the outer shell portion.

8. A golf club head cover comprising:

a body portion having a top portion, a bottom portion, a first side portion extending between the top portion and the bottom portion, a second side portion extending between the top portion and the bottom portion, and an opening located in the bottom portion and accessing an internal cavity configured to house a golf club head;

a magnetic portion within the first side portion and configured to removably attach the golf club head cover to a metallic structure by way of magnetic attraction;

a magnet identifier covering the magnetic portion and configured to provide cushioning between the magnetic portion and the metallic structure; and a golf club head identifier on the second side portion, wherein the golf club head identifier is configured to identify a type of golf club head that the internal cavity is configured to house, and wherein the golf club head identifier is visible when the magnetic portion is magnetically attached to the metallic structure.

9. A golf club head cover as defined in claim 8, wherein the first side portion is a right side portion and the second side portion is a left side portion, a front side portion, or a rear side portion.

10. A golf club head cover as defined in claim 8, wherein the first side portion is a left side portion and the second side portion is a right side portion, a front side portion, or a rear side portion.

11. A golf club head cover as defined in claim 8, wherein the first side portion is a front side portion and the second side portion is a left side portion, a right portion side, or a rear side portion.

12. A golf club head cover as defined in claim 8, wherein the first side portion is a rear side portion and the second side portion is a left side portion, a right side portion, or a front side portion.

13. A golf club head cover as defined in claim 8, wherein the body portion further comprises a front side portion, a rear side portion, a left side portion, and a right side portion.

14. A golf club head cover as defined in claim 8, wherein the body portion has a sock-like shape comprising a front side portion, a rear side portion, a left side portion, and a right side portion.

15. A golf club head cover comprising:

a body portion having a top portion, a bottom portion, an outer shell portion extending from the top portion to the bottom portion, and an opening located in the bottom portion and extending to an internal cavity configured to receive a golf club head;

a magnetic portion concealed in the body portion and beneath the outer shell portion such that the magnetic portion is not visible, the magnetic portion configured to secure the golf club head cover to a metallic structure of a golf cart by magnetic attraction;

a magnet identifier on the outer shell portion and coinciding with a location or a proximate location of the magnetic portion to provide a visual indication of a location of the magnetic portion; and a golf club head identifier on the outer shell portion, wherein the golf club head identifier is configured to identify a type of golf club head that the internal cavity is configured to receive, and wherein the golf club head identifier is spaced apart from the magnet identifier and visible when the magnetic portion is secured to the metallic structure of the golf cart by magnetic attraction.

16. A golf club head cover as defined in claim 15, wherein the magnet identifier has a size that is equal to or smaller than a size of the magnetic portion.

17. A golf club head cover as defined in claim 15, wherein the magnet identifier has a size that is equal to or larger than a size of the magnetic portion.

18. A golf club head cover as defined in claim 15, further comprising:

a second magnetic portion concealed in the body portion and beneath the outer shell portion such that the magnetic portion is not visible; and a second magnet identifier on the outer shell portion and generally with a location or a proximate location of the second magnetic portion, wherein the second magnet identifier provides a visual indication of a location of the second magnetic portion.

19. A golf club head cover as defined in claim 15, wherein the magnetic portion comprises a plurality of magnets.

20. A golf club head cover as defined in claim 15, further comprising a fastening mechanism proximate to the opening, wherein the fastening mechanism allows an area of the opening to be reduced to secure the golf club head within the internal cavity.

* * * * *